United States Patent [19]

Luke

[11] 4,058,237

[45] Nov. 15, 1977

[54] PORTABLE SELF-PROTECTIVE DEVICE

[76] Inventor: Clark Luke, 2210 N. 57 Way, Hollywood, Fla. 33021

[21] Appl. No.: 627,782

[22] Filed: Oct. 31, 1975

[51] Int. Cl.[2] ..... B67D 5/64

[52] U.S. Cl. ..... 222/78; 222/175; 222/394; 222/510; 222/516; 251/227

[58] Field of Search ..... 222/175, 78, 192, 510, 222/516, 552, 549, 394; 239/211, 337; 251/227; 273/84 R; 272/27 R, 8 N; 63/1 R, DIG. 1

[56] References Cited

U.S. PATENT DOCUMENTS

| | | | |
|---|---|---|---|
| 216,627 | 6/1879 | Moore | 251/227 X |
| 316,644 | 4/1885 | Olson | 222/394 |
| 814,605 | 3/1906 | Holly | 222/552 X |
| 1,046,997 | 12/1912 | Desmond | 222/510 X |
| 1,861,644 | 6/1932 | Roberts | 63/1 R |
| 2,184,263 | 12/1939 | Adler | 222/552 X |
| 2,235,350 | 3/1941 | Anderson | 222/175 X |
| 2,478,197 | 8/1949 | Kleiss | 251/227 X |
| 3,830,404 | 8/1974 | Frazer | 222/78 |

FOREIGN PATENT DOCUMENTS

| | | | |
|---|---|---|---|
| 1,187,979 | 4/1970 | United Kingdom | 273/84 R |

*Primary Examiner*—Robert B. Reeves
*Assistant Examiner*—Charles A. Marmor
*Attorney, Agent, or Firm*—Pierce, Scheffler & Parker

[57] ABSTRACT

The present invention relates to a device for protecting a person from attack from an assailant wherein the device is worn on the person in such manner that it is always available for instant operation for defense without the necessity reaching into a pocket or hand bag to thereby enhance the safety of the user.

2 Claims, 3 Drawing Figures

PORTABLE SELF-PROTECTIVE DEVICE

With the rise in the incidence of crimes of violence, the so called "street" crimes and rape, it has become more pressing to develop more efficient means of self protection for such obvious victims as women and older persons. It is apparent that such means must be instantly available, reliable in their operation and free from such hazards as accidental operation when such operation is not desired.

Various portable dispensers for tear gas and the like have heretofore been proposed and such dispensers have been made to appear like items which are generally carried so that they would not be recognized to be defensive devices. For example, such devices were made to resemble fountain pens or cigarette lighters. While such disguises might be effective, such implements are carried in a handbag or pocket and it would be necessary for a prospective victim to try to extract such device from such handbag or pocket when threatened by an assailant. In the face of immediate danger, such an attempt would not be effective and the device would not be available to protect the victim.

The present invention has been made to solve this problem. The first approach to the problem was to make the protective device instantly and continuously available by containing it in a bracelet which is worn on a wrist and therefore is always in position for instant use. However, the exposed position of the device raised problems of safety to the wearer since normal movement of the arm might accidently actuate the device to injure the wearer. Accordingly, to assure safety, a special valve peculiarly adapted to the protective device was developed. The resulting protective device is a simple, reliable and inexpensive means for providing protection to persons who are otherwise defenseless against attack.

It is an object of the present invention to provide an improved self-protective device which is instantly and continually available for use against an assailant.

It is a further object of the present invention to provide an improved self-protective device whose operation is reliable and safe so that the possibility of accidental discharge is minimized.

Other objects and advantageous features of the invention will be apparent from the description and the claims.

The nature and characteristic features of the invention will be readily understood from the following description taken in connection with the accompanying drawings forming part thereof, in which.

It should be understood that the description and drawings herein are illustrative only and that various changes and modifications can be made in the structure without departing from the spirit of the invention.

Like numerals refer to like parts throughout the several views.

Figure 1:
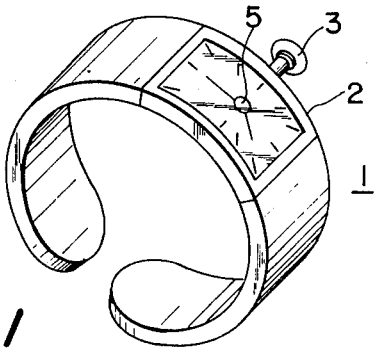
FIG. 1 is a perspective view of a bracelet incorporating the self-protective device.

Referring more particularly to the drawing, the self-protective device is shown in FIG. 1 as bracelet 1 having an inset portion 2 which may simulate a watch or any other decorative device consistent with a bracelet.

Figure 2:
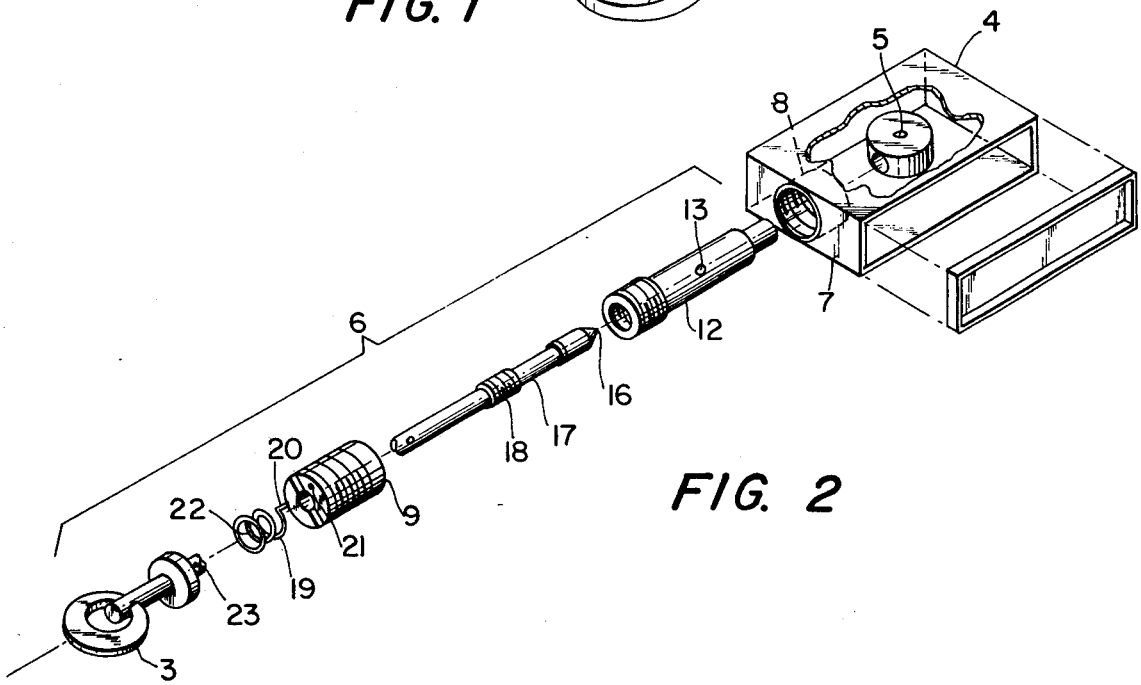
FIG. 2 is an exploded view of the self-protective device including the valve.
Figure 3:
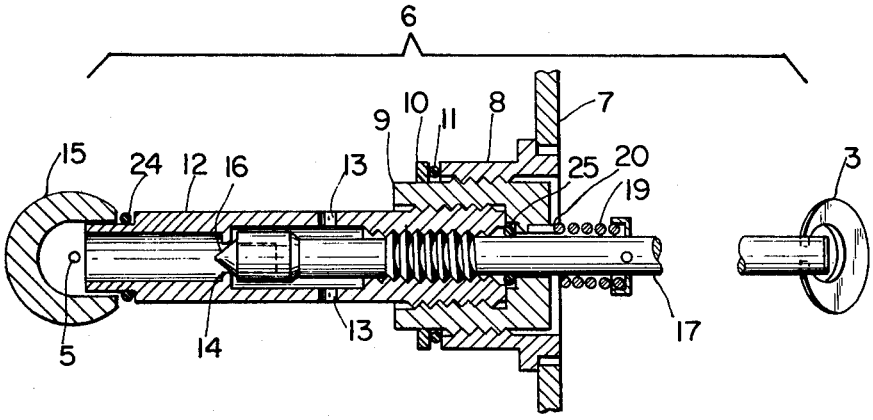
FIG. 3 is an elevation in section of the control valve for the self-protective device.

The control element 3 for the protective device may simulate the winding and setting stem of a watch. An exploded view of the protective device is shown in FIG. 2 wherein casing 4 is adapted to be filled with a protective fluid such as tear gas or Mace under pressure. This protective fluid is adapted to be dispensed as a spray or stream through a nozzle 5 (also shown in FIGS. 1 and 3) under the control of valve 6 which is shown assembled in FIG. 3. Valve 6 is mounted on side wall 7 of casing 4 by means of a collar 8 which is integral with or attached to side wall 7 by welding or similar means. The interior surface of collar 8 is threaded to mate with corresponding threads on cap 9 which is provided with an annular shoulder 10 which faces the end of collar 8 so that a sealing means such as 0 ring 11 provides a fluid tight seal between casing 4 and cap 9. Valve body 12 is provided with threads which mate with threads on the interior surface of cap 9 so that valve body 12 is screwedly attached to and fixed in cap 9. Valve body 12 is provided with intake ports 13 which communicate with the interior of casing 4 and an exit port 14 which communicates with output chamber 15 of casing 4 and nozzle 5. The flow of fluid through exit port 14 is controlled by a valving element 16 which is mounted on the end of and is integral with valve stem 17 which is provided with threads 18 which mate with matching threads on the interior surface of valve body 12 so that as valve stem 17 is turned by control element 3, valving element 16 is reciprocated toward and away from exit port 14 to control the dispensing of fluid material from the protective device. Valve stem 17 is biased to a closed position by rotary spring 19 which is provided with an end portion 20 which is secured to cap 9 by a hole 21 therein and an end portion 22 which is secured to valve stem 17 by a hole 23. In order to provide fluid tight seals at points where such leakage might occur, 0 rings are provided at such points; note 0 ring 24 between valve body 12 and output chamber 15; 0 ring 25 on valve stem 17 between body 12 and cap 9.

In use, bracelet 1 is worn on the wrist of the person to be protected. To the casual observer, the bracelet would appear to be an ordinary wrist watch or ornamental bracelet. In the presence of danger, the raising of one's hands would be a normal act and such movement would bring the protective device into operative position and a turn of control knob 3 would produce a jet or spray of protective fluid which would incapacitate the attacker and permit the endangered person to escape from the dangerous condition. The device is inherently safe since control knob 3 is biased to closed position by spring 19 and threads 18 on valve stem 17 would prevent accidental reciprocation thereof.

It is accordingly apparent that the self protective device of the present invention provides a degree of safety and protection which is highly desirable.

It is apparent to the person skilled in the art that modifications and equivalents may be used without departing from the spirit of the present invention and the scope of the present invention should be limited only by the appended claims.

I claim:

1. A portable self-protective device adapted to be worn on the wrist of a person to be protected in the form of a bracelet, comprising a compartment integral with said bracelet, said compartment containing a quantity of protective fluid material under pressure on said compartment, an outlet nozzle for dispensing said protective fluid material in the form of a directionally controlled stream or spray; means in said compartment for selectively controlling the flow of said protective fluid from said compartment to said nozzle, said means comprising an elongated valve body having an outlet port in communication with said nozzle at one end thereof and at least one inlet port intermediate the ends of the body providing communication between the interiors of said compartment and said valve body; a valve means movable to and from said outlet port to control the flow of said protective fluid through said outlet port, said valve means being mounted integrally on the end of a valve rod extending through the interior of said valve body and seating on the upstream side of said outlet port so that said protective fluid material under pressure acts to more firmly seat said valve means on said outlet port, said valve means having a conical surface which seats on and enters into said outlet port, said valve rod extending out of the compartment and having a threaded portion which mates with cooperating threads on the interior surface of said valve body, whereby rotation of said valve rod by a wearer of the bracelet causes linear movement of said valve means to and from said outlet port to control the flow of protective fluid material through said outlet port, and rotary motion with respect to said outlet port to provide a wiping action between the mating surfaces of said outlet port and said valve means, spring biasing means for biasing said valve means to a closed position to prevent the flow of protective fluid material through said outlet port, control means for rotating said valve rod against the bias of said spring biasing means whereby said control means determines whether protective fluid material is dispensed to protect said person.

2. A portable self-protective device according to claim 1 wherein the top surface of said compartment stimulates a watch face.

* * * * *